United States Patent [19]

Schnell

[11] Patent Number: 4,901,934

[45] Date of Patent: Feb. 20, 1990

[54] DEVICE FOR WINDING A CONTINUOUS LENGTH OF MATERIAL

[76] Inventor: Heinrich Schnell, Schwanheinerstrasse 78a, 6930 Eberbach, Fed. Rep. of Germany

[21] Appl. No.: 182,773

[22] Filed: Apr. 18, 1988

Related U.S. Application Data

[63] Continuation of Ser. No. 855,817, Aug. 10, 1986, abandoned.

[30] Foreign Application Priority Data

Aug. 10, 1984 [DE] Fed. Rep. of Germany ..... 3429463
Aug. 10, 1984 [DE] Fed. Rep. of Germany ..... 3429462

[51] Int. Cl.[4] ..... B65H 18/16
[52] U.S. Cl. ..... 242/56 R; 242/66
[58] Field of Search ..... 242/56 R, 56 A, 67.3 R, 242/65, 66

[56] References Cited

U.S. PATENT DOCUMENTS

| | | | |
|---|---|---|---|
| 2,332,371 | 10/1943 | Corbin . | |
| 2,599,942 | 6/1952 | Roen . | |
| 2,670,152 | 2/1954 | Priest . | |
| 2,950,873 | 8/1960 | Nelson . | |
| 3,167,268 | 1/1965 | Birch . | |
| 3,633,840 | 1/1972 | Clark | 242/56 R |
| 3,727,853 | 4/1973 | Kinoshita | 242/56 A |
| 3,734,423 | 5/1973 | Kataoka | 242/56 A |
| 3,817,467 | 6/1974 | Dambroth | 242/564 |
| 3,848,824 | 11/1974 | Van Schijndel | 242/56 R |
| 4,000,863 | 1/1977 | Straujups | 242/56 R |
| 4,040,574 | 8/1977 | Johnson | 242/56 A |
| 4,515,821 | 5/1985 | Kahlman | 242/56 R |

FOREIGN PATENT DOCUMENTS

| | | |
|---|---|---|
| 0019228 | 8/1980 | European Pat. Off. . |
| 1499125 | 6/1970 | Fed. Rep. of Germany . |
| 1574426 | 1/1972 | Fed. Rep. of Germany . |
| 2425454 | 4/1975 | Fed. Rep. of Germany . |
| 2844519 | 4/1979 | Fed. Rep. of Germany . |
| 3033765 | 10/1981 | Fed. Rep. of Germany . |
| 2168046 | 7/1973 | France . |

*Primary Examiner*—Stuart S. Levy
*Assistant Examiner*—Katherine Matecki
*Attorney, Agent, or Firm*—Peter K. Kontler

[57] ABSTRACT

A device for winding successive sections of a web of flexible material onto individual, successively fed cores, wherein the leader of a new section of the web is laid under the first convolution of the new section by means of a roller. A cutting mechanism pivots the roller against the leader in response to movement to an operative position in which it severs the web.

3 Claims, 18 Drawing Sheets

DEVICE FOR WINDING A CONTINUOUS LENGTH OF MATERIAL

This is a continuation of co-pending application Ser. No. 855,817, filed Aug. 10, 1986, now abandoned.

BACKGROUND OF THE INVENTION

Field of the Invention

The invention relates to a device for winding a continuous length of material onto individual, successively fed cores, with a taken-up roller, across the extent of which the material is fed in, a finishing roller, both rollers being driven in the same direction of rotation at the same circumferential speed, a magazine feeder attachment for cores, a core transfer by means of which a core that is placed in readiness in the magazine is brought into a winding-on position in contact with the take-up roller, a transfer arrangement, by means of which the partially wound roll of material is brought into a finishing-off position in contact the finishing roller, with a cutting mechanism for cutting the length of material, which can be applied to a section of the length of material between the take-up roller and the finishing roller, a laying arrangement, which is associated to the take-up roller, for fixing the start of a new section of the length of material round a new core and a roll guide that is associated to the finishing roller.

With such devices, it is important that the new start of the section of the length of material is fixed quickly and securely round the new core.

DESCRIPTION OF THE RELATED ART

U.S. Pat. No. 3,910,517 discloses a device wherein the start of the length of material is pressed onto the new core by means of compressed air and then wound over.

In the case of a winder disclosed in U.S. Pat. No. 4 422 588, the new start of the length of material is stuck on by means of double-sided, self-adhesive tape.

SUMMARY OF THE INVENTION

Object of the present invention is to design a device of the type initially described wherein the core changeover is carried out as simply and reliably as possible.

The invention can be used for lengths of heavy materials as well as for light-weight, flexible materials. Heavy materials can, for example, be carpets and even carpets with a heavy pile. Such heavy materials can only be cut while at a standstill. A further development of the invention, which takes this into account is particularly advantageous for use with lengths of heavy materials. By means of the layer roller provided with this design, the new initial section resulting during cutting, is laid round the core. When the material feed is switched on again, the new initial section enters the space between the core and the take-up roller and thus under the first layer of the length of material, whereby it is fixed in position.

If the new initial section is longer than the space available on the circumference of the core, there is an unwanted build-up or crease. This is avoided by applying the cutting mechanism to the section of the length of material at a point suitably close to the winding-round roller which is in a winding-round position.

It is important that during the laying process the initial section is fed round the circumference of the core neatly and without creasing.

In the case of pile materials, it is advisable to wind them with the pile facing outwards. However, it is also possible to wind them with the pile facing upwards.

In the case of flexible materials, for example fabrics or foils, it is possible to change over the core while the material continues to be fed.

By means of the turning arrangement provided with this design, the start of the length of material is folded over and pushed under the wrap of the new core, whereby it is immediately fixed in position between the length of material and the core. The initial section that projects over the fold edge is incorporated in the course of further rotation of the core and is then held firmly in position on the core.

So that the new end of the length of material resulting from cutting does not hang over too long, the actuation of the turning device and the cutting mechanism must be exactly synchronized.

The transfer arrangement is advantageous because it only requires one additional carriage with carriage guide and the core transfer participates in the transfer arrangement, so that the core transfer can carry the core from the magazine feeder attachment via the winding-on position through to the finishing position.

BRIEF DESCRIPTION OF THE DRAWINGS

FIGS. 18 to 24 show a modified version of the device which is suited for winding a continuously fed length of flexible material.

FIG. 1 shows parts applied to the cores and rolls of material in an operating position when finishing off the illustrated roll of material.

FIG. 2 shows parts from FIG. 1 in an operating position shortly before completion of the roll;

FIG. 3 shows parts from FIG. 1 when cutting the length of material and fixing the start of the new section of the length of material round the new core;

FIG. 4 shows parts from FIG. 1 when rejecting the finished roll and winding on the new roll;

FIG. 5 shows parts from FIG. 1 after the partially wound roll has been transfered into the finishing-off position;

FIG. 6 shows parts from FIG. 1 after the core transfer has passed the partially wound roll to the roll guide, swung back and taken up a core that was placed in readiness in the magazine feeder attachment for cores;

FIG. 7 shows a winder with parts in the position shown in FIG. 1, partial open view, viewed from the front;

FIG. 8 shows the part of FIG. 7 marked off by the broken line VIII, however, viewed from the rear, enlarged and with added details;

FIG. 9 shows the part of FIG. 7 marked off by the broken line IX, enlarged and with further details;

FIG. 10 is a view in the direction of arrow X in FIG. 7

FIG. 11 is a sectional view in the direction of arrows XI in FIG. 7;

FIG. 12 is a partial view in the direction of arrow XII in FIG. 7;

FIG. 13 shows a core transfer, whereby in A it is viewed from the side in the direction of arrow XIII A and in B from the front in the direction of arrow XIII B;

FIG. 14 shows a layer arm, whereby in A it is viewed in section in the direction of arrow XIV B and in B from the side in the direction of arrow XIV A;

FIG. 15 shows parts of the roll guide, whereby in A it is viewed in the direction of arrow XV A and in B in the direction of arrow XV B, partial open view;

FIG. 16 shows a circuit diagram;

FIG. 17 is a sectional view of a winding roller with drive located inside the roller;

FIG. 18 shows parts affected by the modification that are applied to the cores and rolls of material shown in an operating position when finishing off the illustrated roll as in FIG. 1;

FIG. 19 shows parts from FIG. 18 shown in an opening position shortly before completion of the roll;

FIG. 20 shows parts from FIG. 18 when cutting the length of material and fixing the start of the new section of the length of material round the new core;

FIG. 21 shows parts from FIG. 18 when rejecting the finished roll and winding on the new roll;

FIG. 22 is a sectional view of device according to FIG. 11;

FIG. 23 shows a layer arm, whereby in A it is viewed in section in the direction of arrow XXIII B and in B from the side in the direction of arrow XXIII A.

DESCRIPTION OF THE PREFERRED EMBODIMENTS

Figure 7:
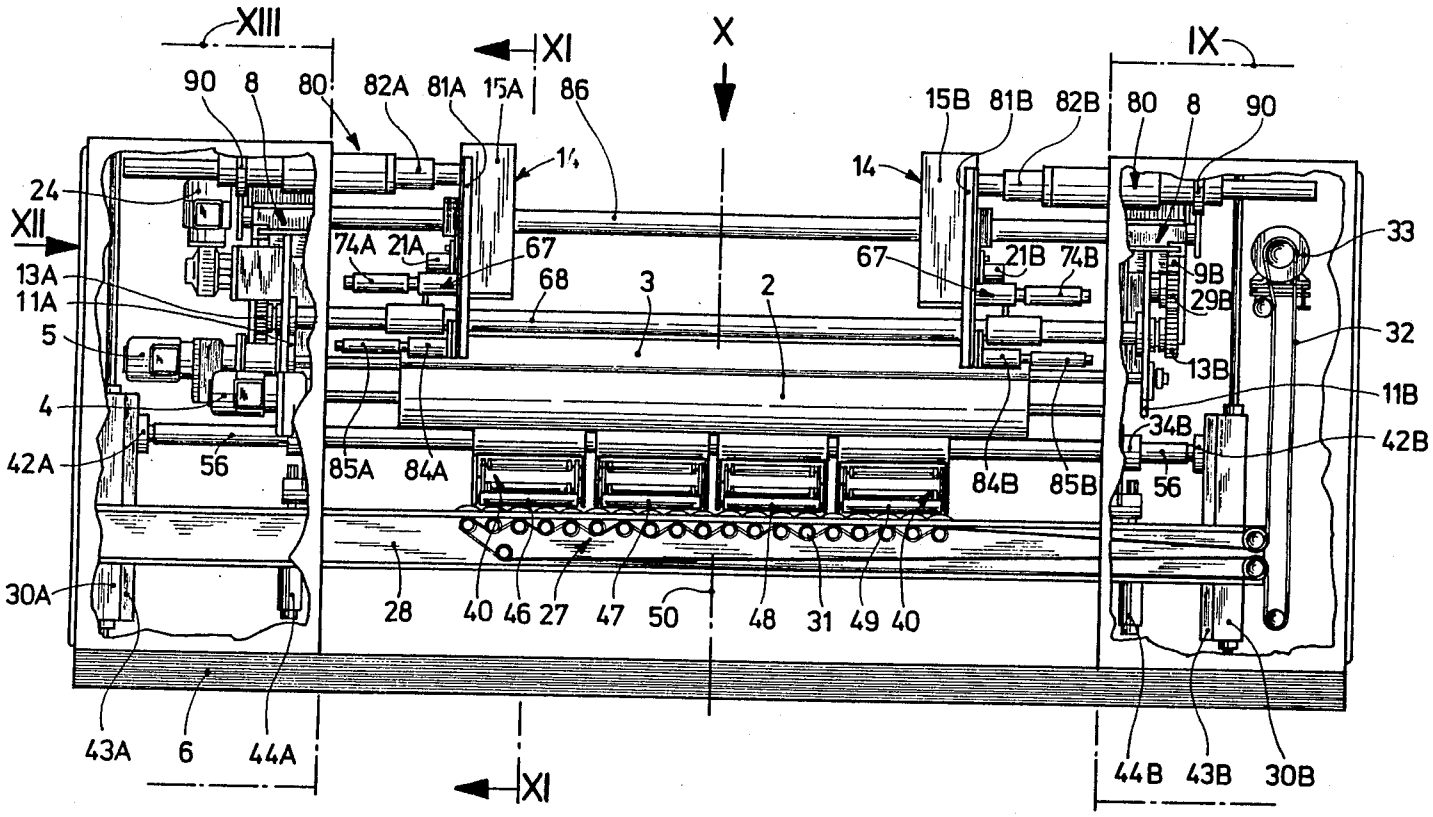
Figure 8:
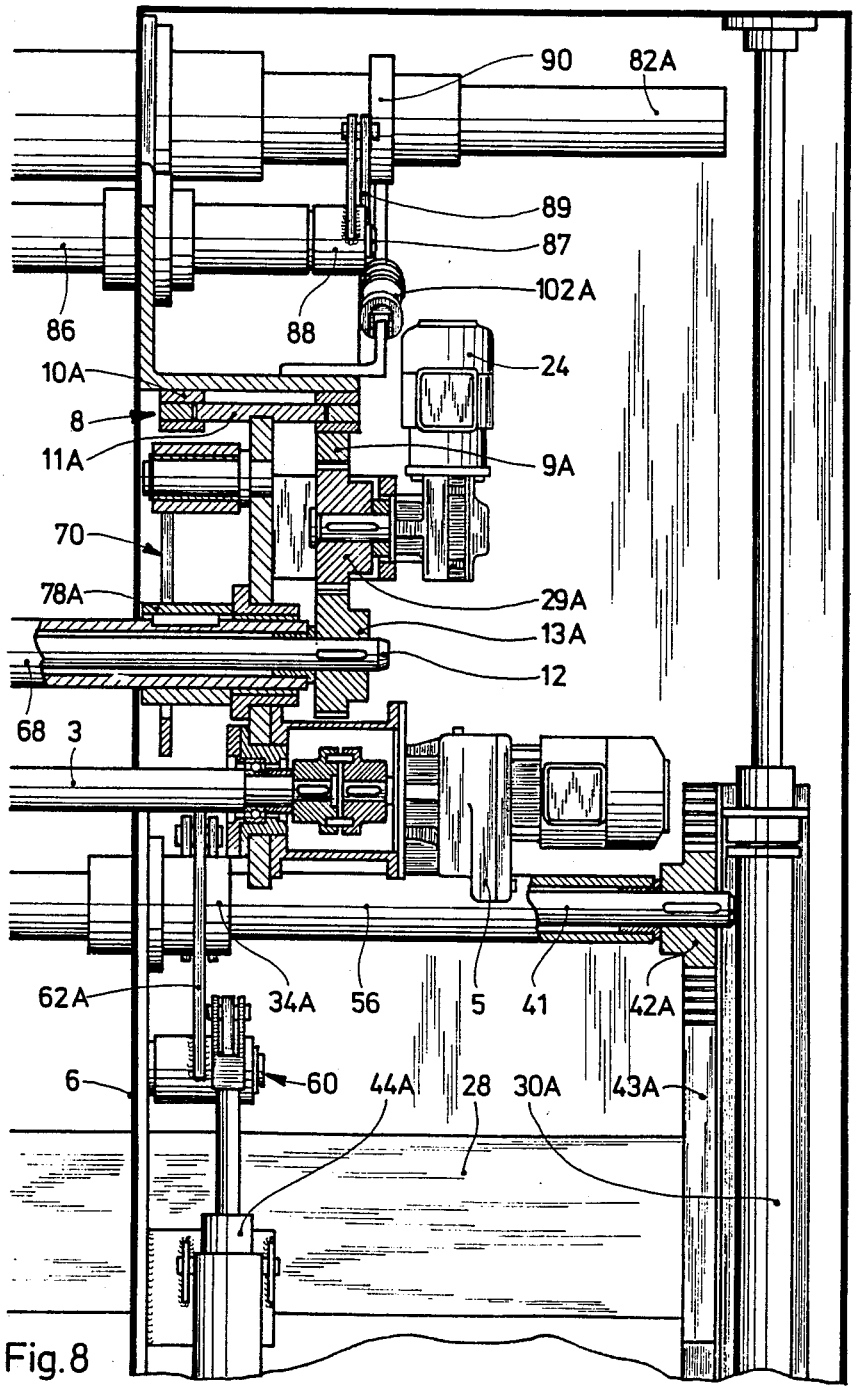
Figure 9:
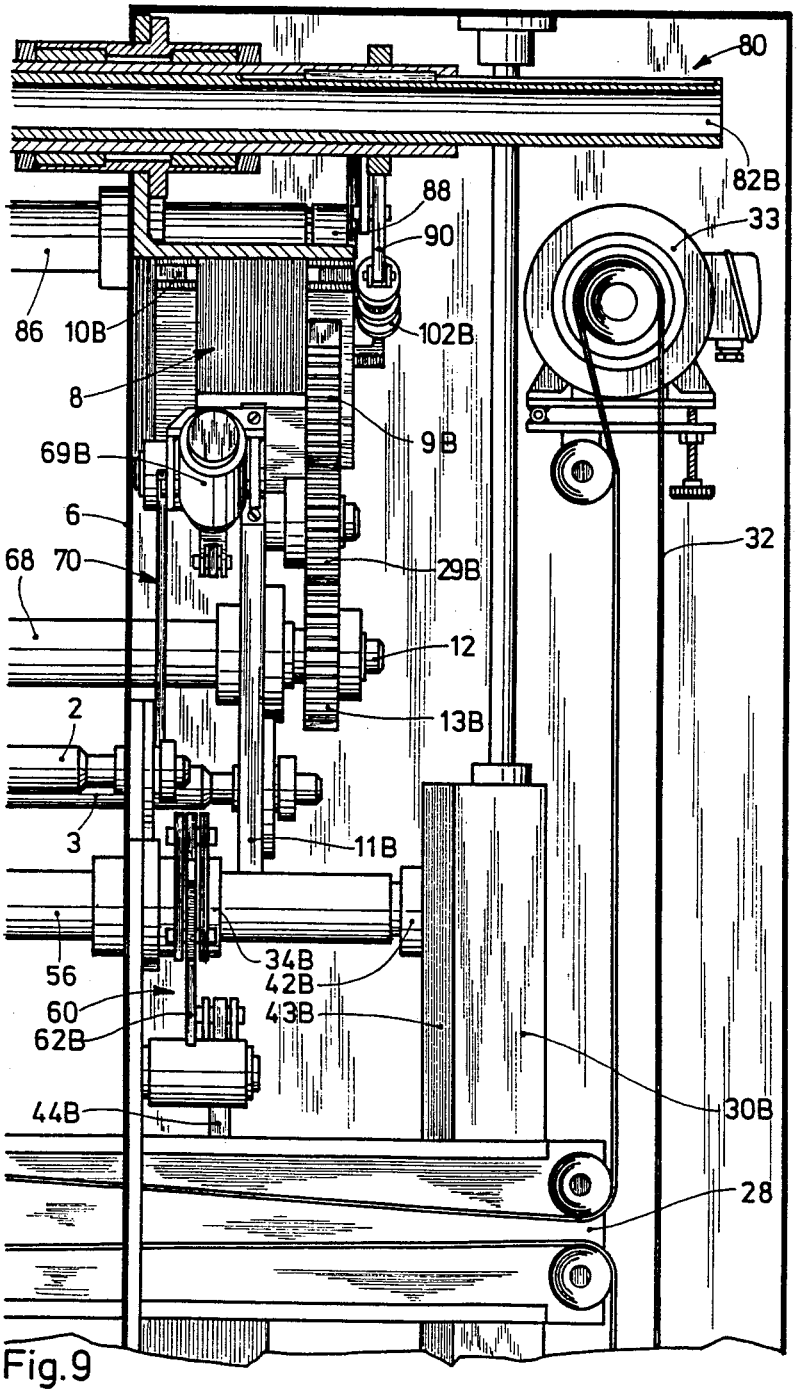
Figure 10:
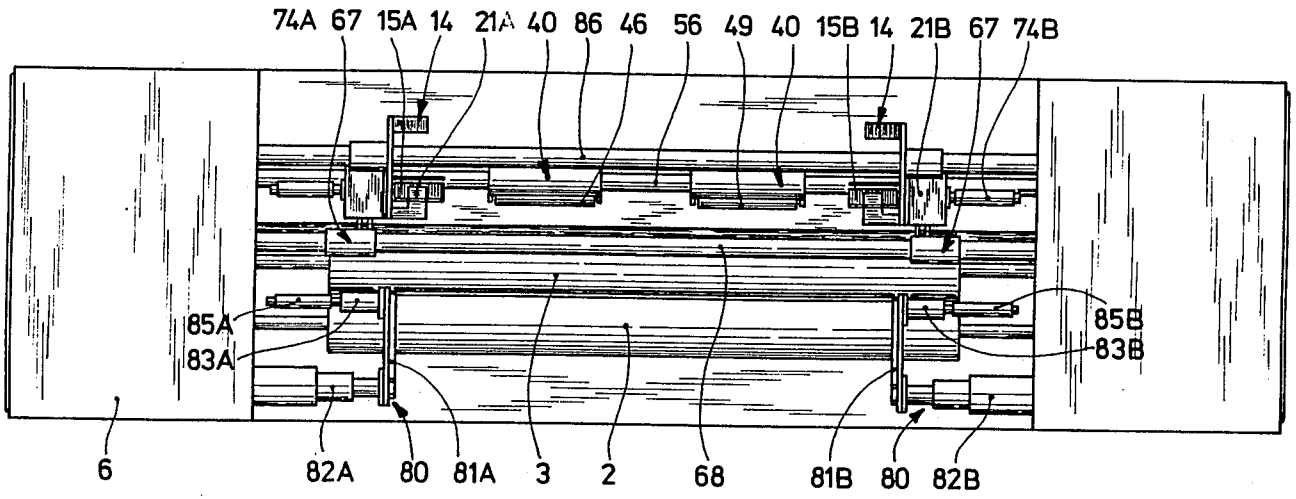

In the drawing parts which are available in duplicate and are located on both sides of the roll are marked with the same reference number, whereby parts located on the left according to FIG. 7 are marked with A and parts located on the right according to FIG. 7 are marked with B. Unless described or illustrated differently, these parts are arranged mirror symmetrically to each other.

Figure 6:
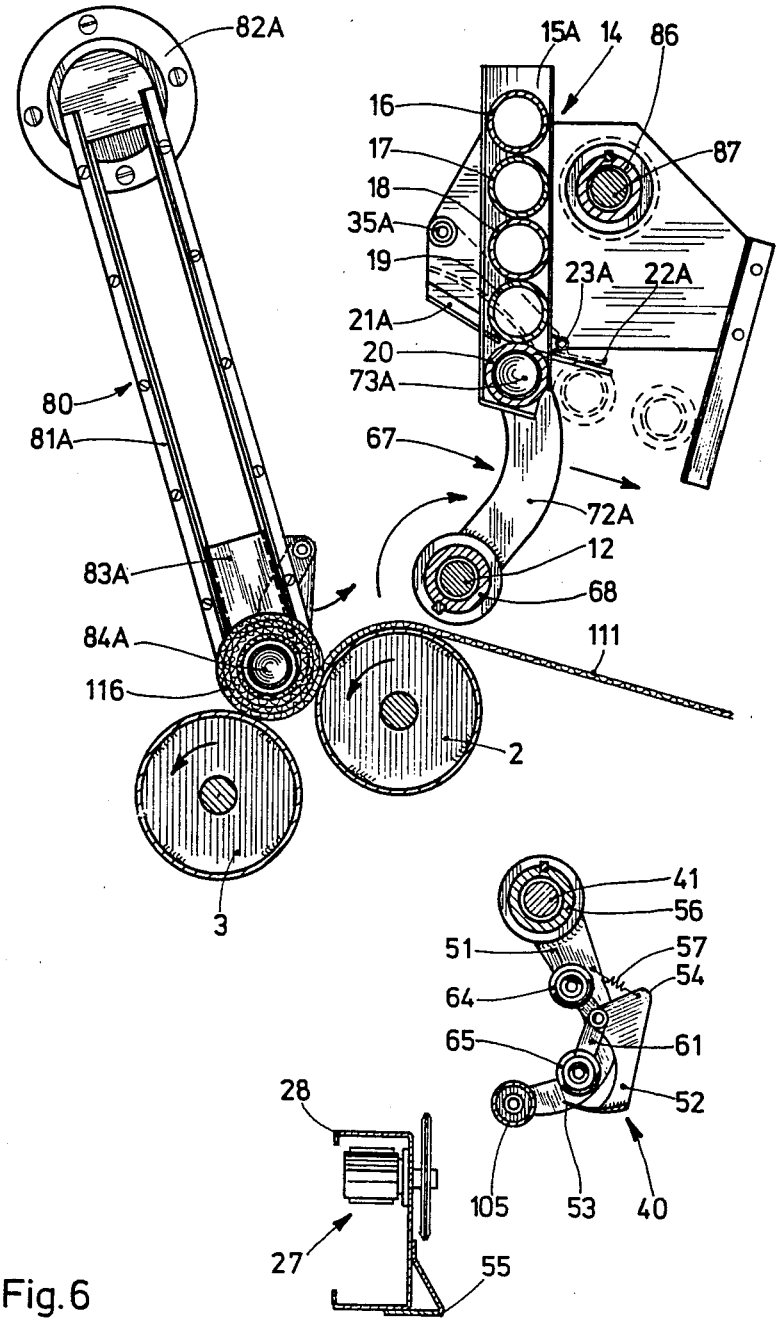

In the drawing the continuously fed length or web of material, which can, for example, be a length of fabric, is marked with 1. It is only shown in some figures to give a clearer overall impression. A rotary winding member here shown as a take-up roller 2 and a finishing roller 3 which is an element of the means for advancing the web 1 in a predetermined direction along a predetermined path are arranged axially parallel, have the same diameter and are driven at the same circumferential speed in the same direction of rotation of the drive motors 4 and 5. The finishing roller 3 is mounted in a fixed position in the machine framework 6. The take-up roller 2 is mounted on a carriage guide 8 and can be moved back and forth in a straight-line. The carriage guide comprises a gear rack 9 A, B, which is mounted on the machine framework 6, a rail guide 10 A, B and a carriage 11 A, B. The carriage is driven by a drive motor 24 that is mounted on the carriage 11 A and drives a pinion 29 A, which meshes with the gear rack 9 A. In addition, the pinion 29 A drives a gear wheel 13 A. Together with the gear wheel 13 B, the gear wheel 13 A is mounted on the shaft 12 in such a way that it cannot turn in relationship to it. The shaft 12 is mounted on the carriage 11 A, B. The gear wheel 13 B meshes via the rotatably-mounted idler gear wheel 29 B with the gear rack 9 B. The end positions of the carriage movement are shown in FIG. 6 and FIG. 1.

Above the take-up roller 2 there is a source 14 of cores in the form of a magazine feeder attachment that is mounted on the fixed bearing tube 86 in such a way that it cannot be turned in relation to tube but so that it can be adjusted axially. The core magazine features a core shaft or duct 15 A, B. This core shaft extends vertically and has guides for both ends of tubular cores 16 to 20, which fit with play, one above the other in the core shaft 15 A, B. The core is open at both ends and hollow.

21 A, B refers to an allotter, which is pivot-mounted in a bearing 35 A, B. In addition, there is a retaining flap 22 A, B that is swivel-mounted in a bearing 23 A, B. The allotter 21 A, B is operated against gravity and the retaining flap 22 A, B against spring resistance by a core transfer 67.

Figure 1:
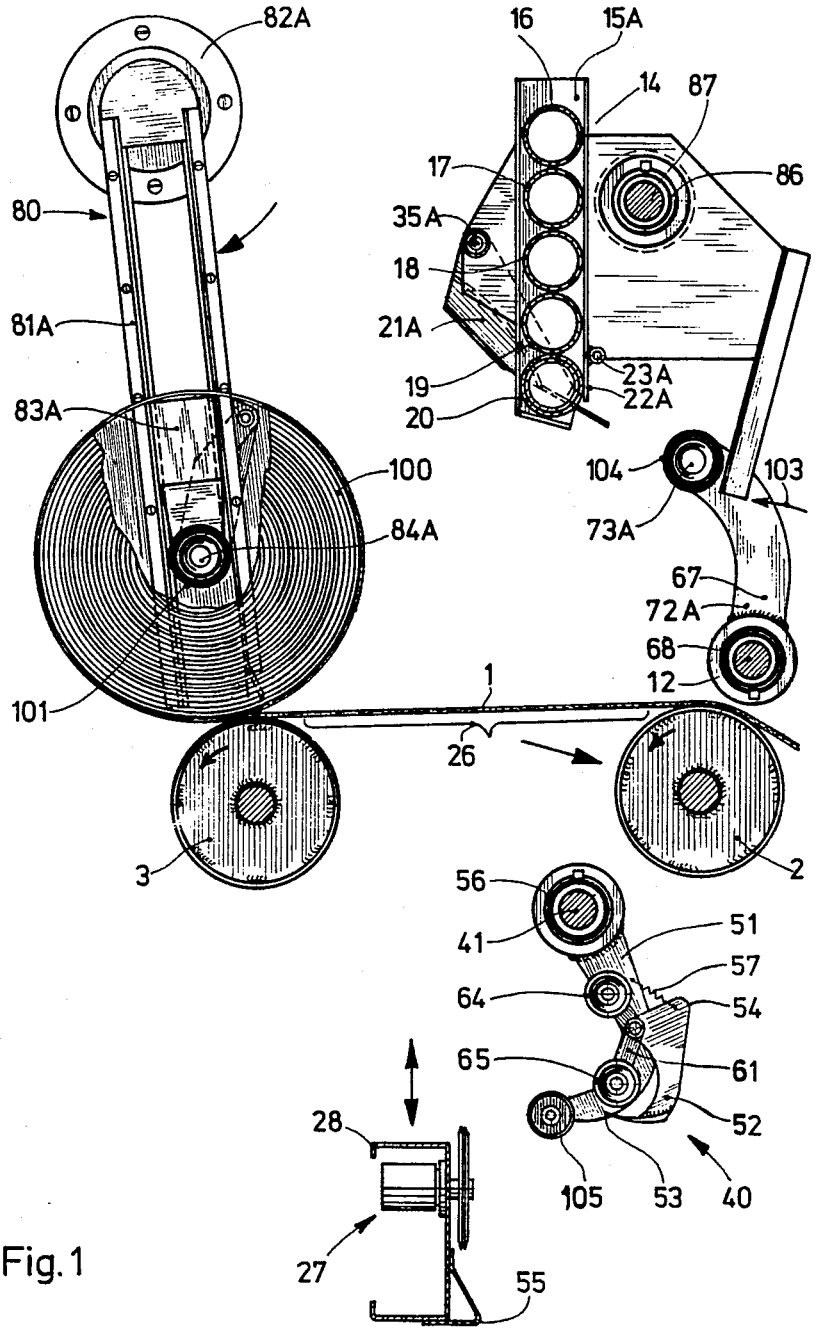
FIGS. 1 to 17 show a device for winding heavy materials.
Figure 2:
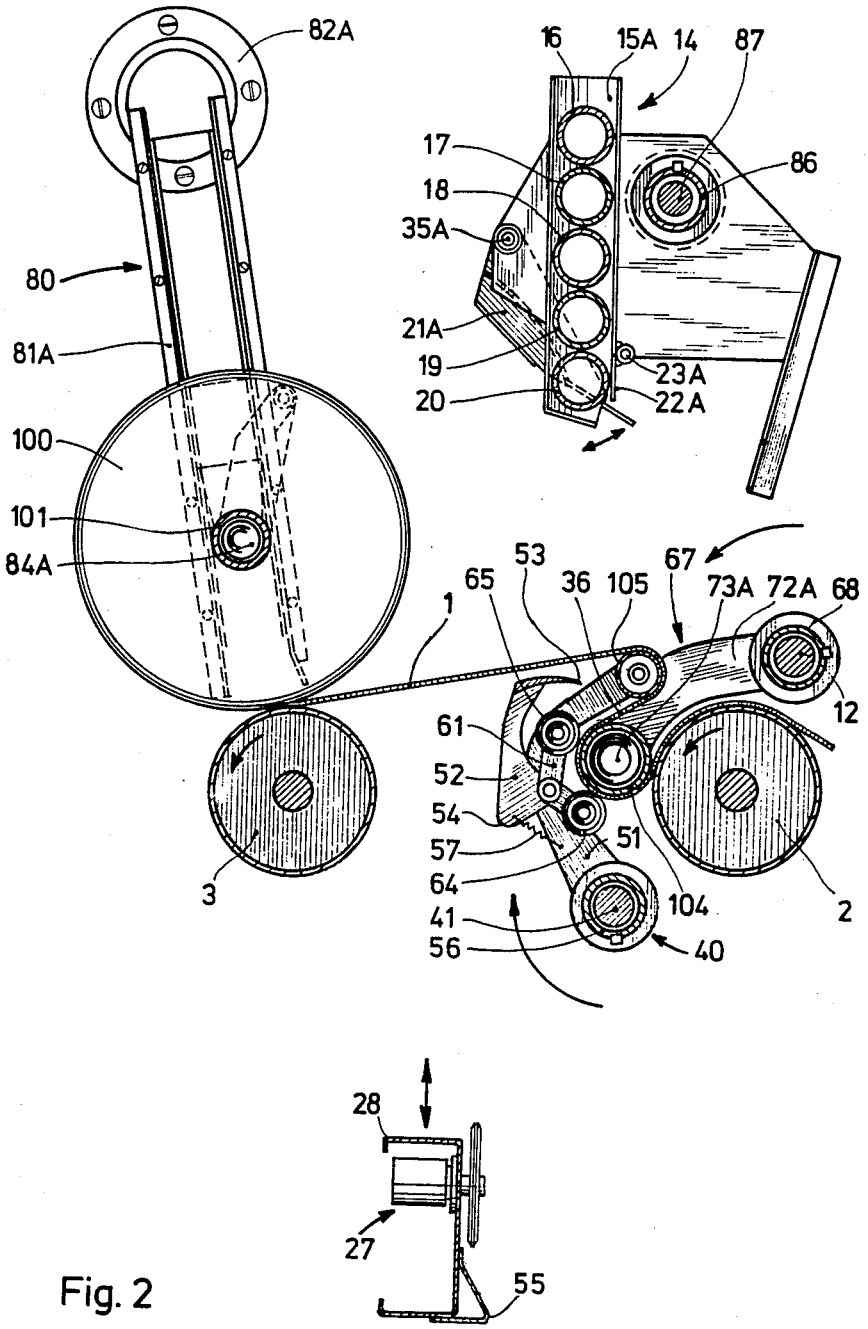

In the winding-on position shown in FIG. 1 there is a space between the finishing roller 3 and the take-up roller 2 that is spanned by a section of the length of material being processed. This section of the length of material is referred to as functional section 26.

There is a cutting mechanism 27 is located beneath this functional section. The cutting mechanism 27 serves to repeatedly cut the web 1 and comprises a cutter bar 28 that can adjusted vertically in height on both sides by moving means in the form of hydraulic cylinders 30 A, B.

The two cylinders 30 A, B are synchronized by means of two gear wheels 42 A, B that are mounted on a shaft 41 in such a way that they cannot turn in relation to it. The gear wheels 42 A, B mesh with the gear racks 43 A, B. The gear racks 43 A, B are mounted on the cylinders 30 A, B.

On the cutter bar 28 there is a row 31 of cutter discs which extend across the complete maximum width of the length of material being processed.

Figure 3:
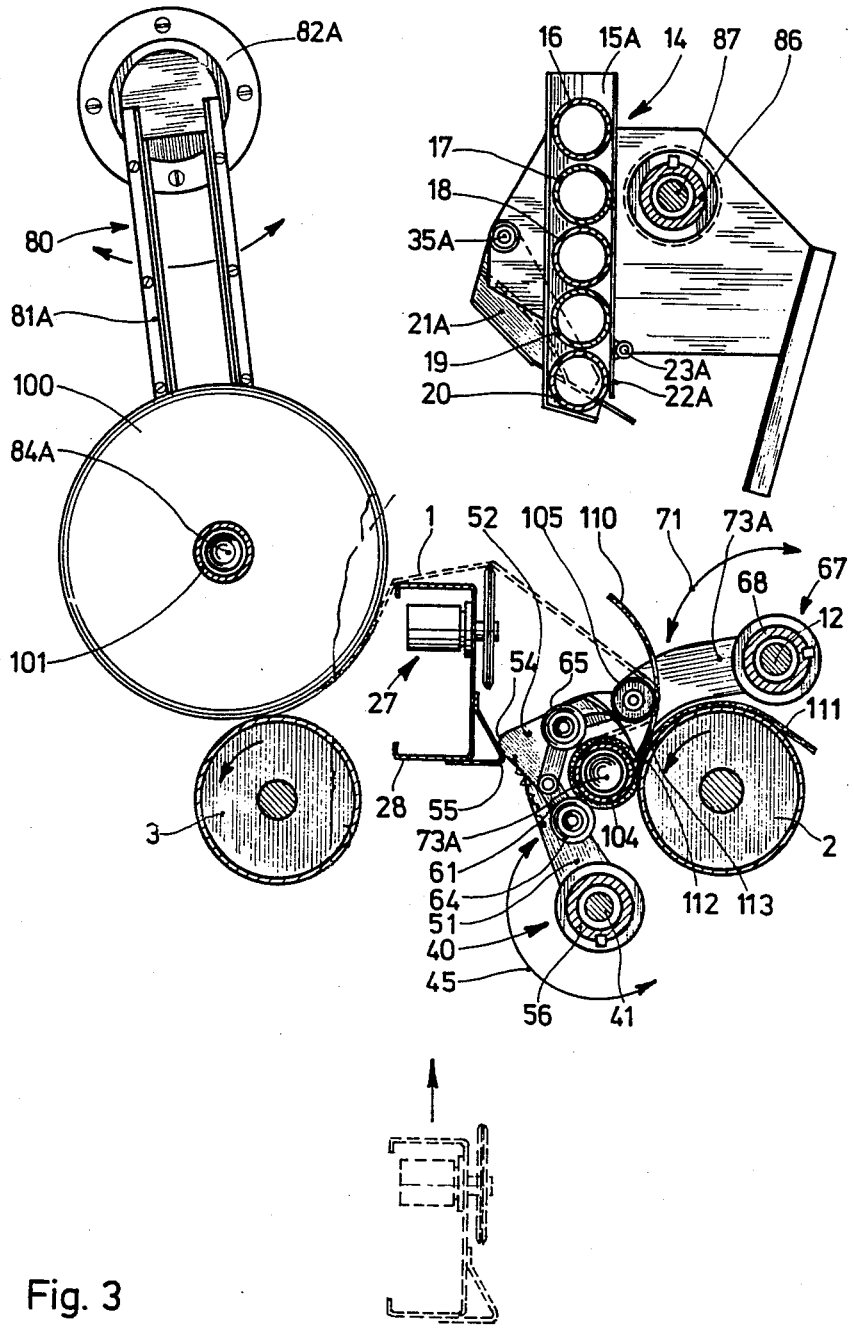

The cutter discs of this row 31 are rotated by a motor 33 over a rope drive 32. The rotating cutting edges of the cutter discs form a cutting edge that is directed upwards. In FIG. 1 and FIG. 7 the cutting mechanism is illustrated in its lowered, idle position. In FIG. 3 it is shown in the raised cutting position, in which it severs the taut length of material 1 in the functional section 26 with the cutting edges of the cutter discs.

Located beneath the functional section 26 there is a layer arrangement 40, which serves to fix the new start of a section of a length of material in position on the new core 104. The layer is mounted on a rotatable hollow shaft 56 in such a way that it cannot turn in relation to it. The hollow shaft 56 for the layer is rotatably-mounted coaxially to shaft 41. The swivelling movements of the hollow layer shaft 56 are driven by a hydraulic cylinder 44 A, B over a hinged lever combination 60, which is connected to the hollow shaft 56 in such a way that it cannot turn in relation to it with a keyed bush 34 A, B. The hinged lever combination 60 features the hinged lever 62 A, B. The layer arrangement 40 is mounted on the hollow shaft 56 in such a way that it cannot turn in relation to it but that it can be adjusted axially. The layer is adjusted axially by hand in accordance with the working width.

With every laying cycle the hollow layer shaft 56 moves back and forth through an angle 45 of more than 180°. The layer arrangement 40 consists of four identical layer elements 46 to 49. Each of the layer elements is arranged mirror-symmetrically to a plane of symmetry that is only shown for the layer element 46 in FIG. 7. The four layer elements 46 to 49 extend across the complete width of the length of material being processed. More layer elements can be added for wider lengths of material. Fewer layer elements are sufficient for narrower lengths of material.

The layer element 46 that can be seen in FIGS. 1–6 and 11 features a layer arm 51 that is connected with the hollow layer shaft 56 in such a way that it cannot turn in relation to it. On the layer arm 51 there is a swivel-mounted rocking arm 61. A first draping member in the form of a winding roller 53 is mounted on the outer end of the rocking arm 61 and the auxiliary winding roller 52 on the inner end of the rocking arm 61. On the free end of the layer arm 51 there is a pivoted swivel arm 64. On the free end of the swivel arm 64 there is a rocking arm 63. A second draping member in the form of a layer roller 54 is rotatably mounted on the outer end of a moving means including a rocker arm 63 and the auxiliary layer roller 55 is rotatably mounted on the other end of the rocker arm 63. Coaxial to the swivelling axis of the swivel arm 64 there is a pinion 57, that is mounted in such a way that it cannot turn in relation to the swivel arm 64. The pinion 57 meshes with a gear rack 58, which is mounted in a guide 59 on the layer arm 51. The gear rack 58 is moved back and forth by a hydraulic cylinder 65, which is mounted on the layer arm 51. By actuating the hydraulic cylinder, the swivel arm 64 with the rocking arm can be moved from the idle position shown in FIGS. 1, 2 and 3 into the laying position opposite the layer arm 51 shown in FIG. 4. The layer arm 51 is a means for moving the roller (first draping member) 51 into engagement with a first portion of the leader 110 of a section 111 of the web 1.

The core transfer 67 is swivel mounted on the carriage 11. The core transfer 67 has a hollow shaft 68, which is rotatably mounted coaxially to the shaft 12. The arm of 72 A, B the core transfer is mounted on the shaft 68 in such a way that it cannot turn in relation to the shaft but that it can be adjusted axially. The arm is adjusted axially according to the working width. The numbers 69 A, B refer to a hydraulic cylinder, which is coupled to a keyed bush 78 A, B via a hinged lever combination 70 A, B. The keyed bush 78 A, B is seated on the core transfer shaft 68 in such a way that it cannot turn in relation to it.

Figure 5:
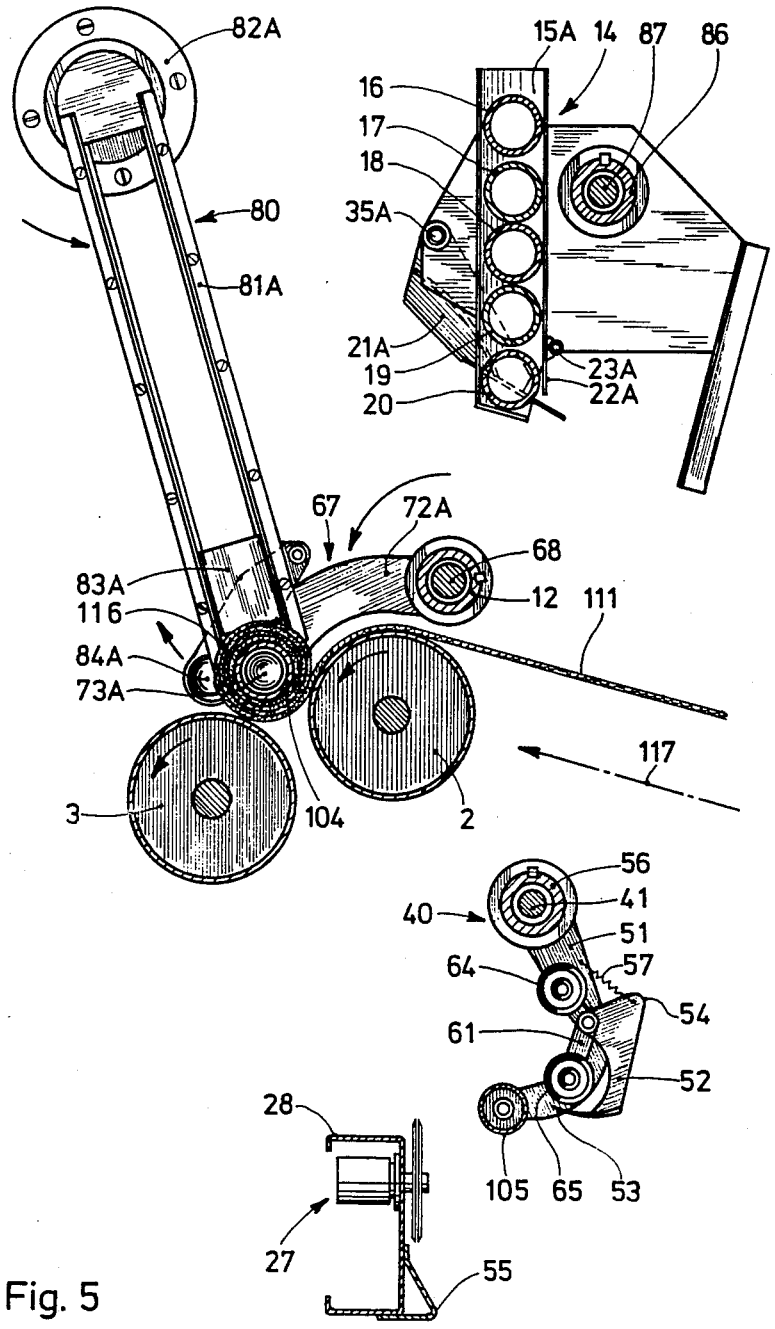
Figure 11:
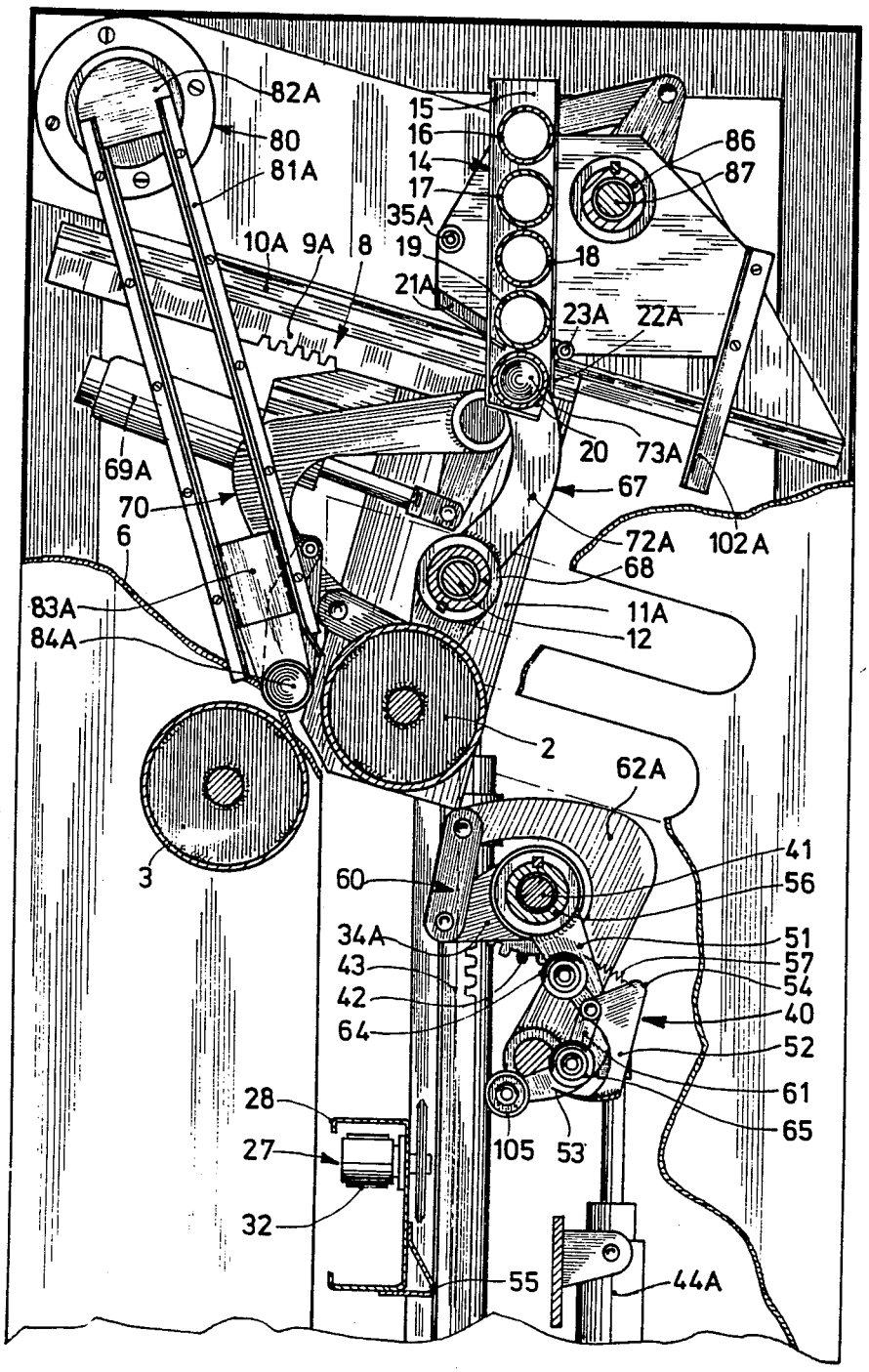
Figure 12:
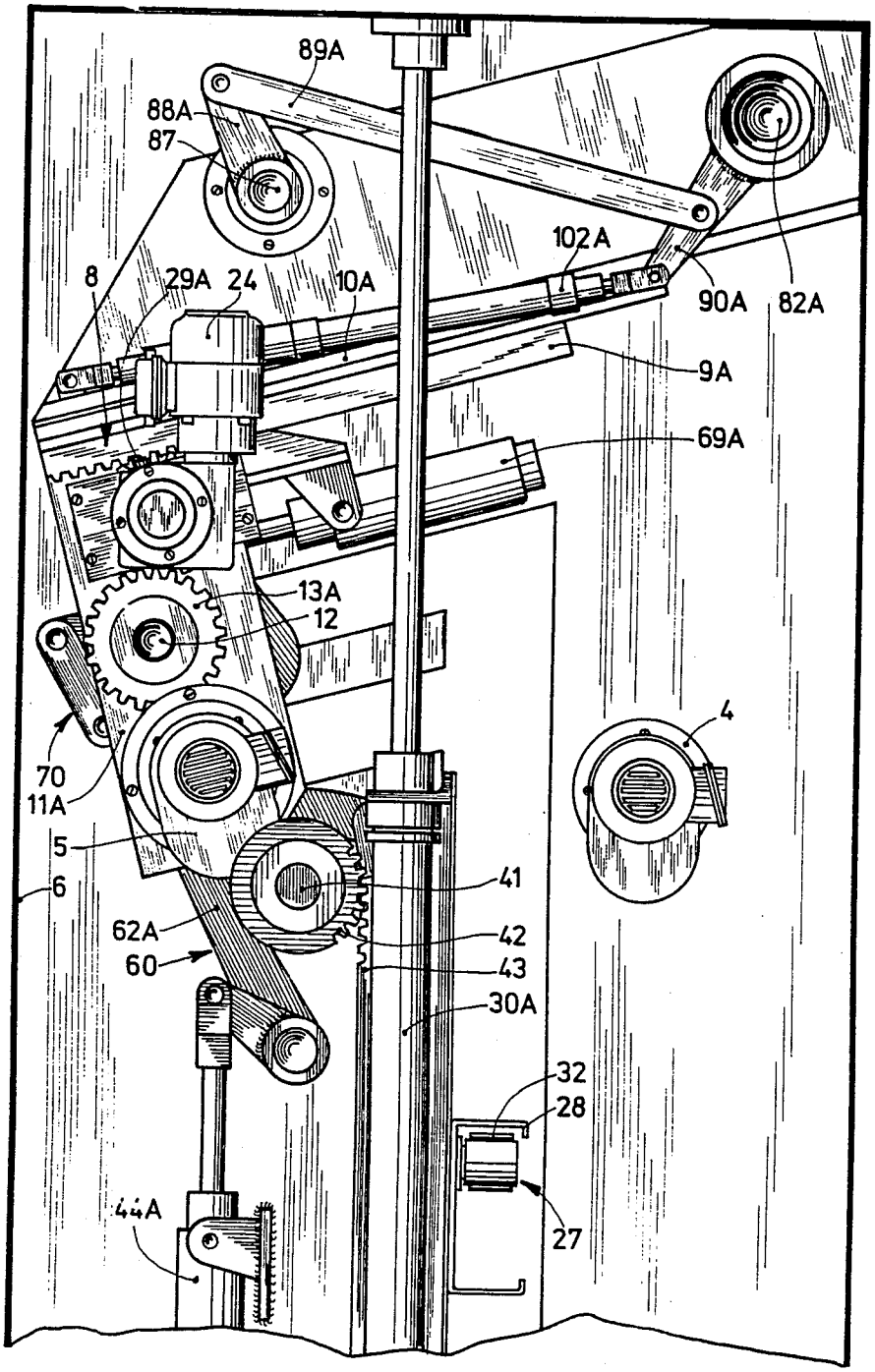

In FIG. 5 the core transfer 67 is shown in one of the end positions of the swivelling movement and in FIG. 11 it is shown in the other end position of the swivelling movement. On the free end of the core transfer arm 72 A, B there is a core pick-up 73 A, B.

Figure 13A:
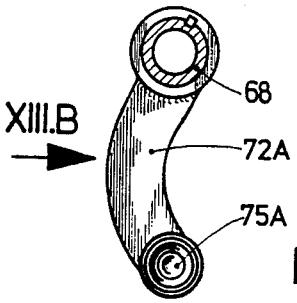
Figure 13B:
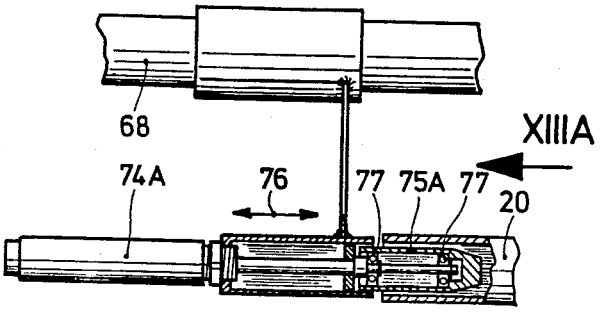
Figure 14A:
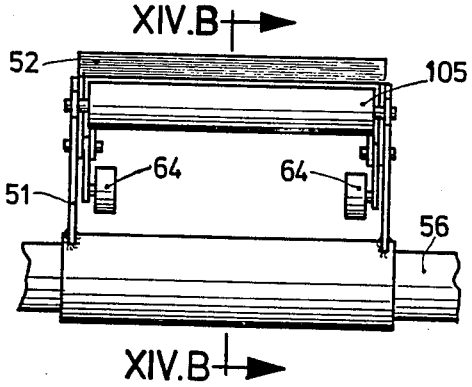
Figure 14B:
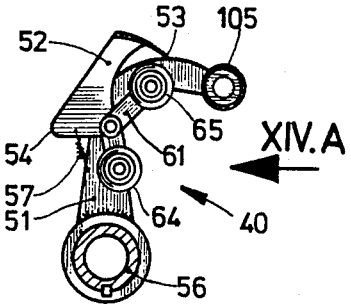

As can be seen in FIG. 13, the core pick-up features a hydraulic cylinder 74 A, B that moves a mandrel 75A, B in the direction of arrow 76, so that, in the position shown in FIG. 13B, it engages in the hollow end of an adjacent core 20. In its retracted position, it does not engage in the core and releases it. The mandrel 75 A, B is rotatably mounted in ball bearings 77.

Figure 15A:
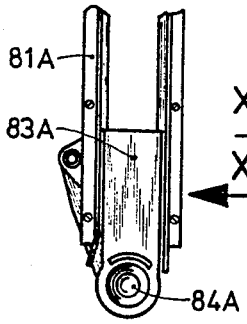
Figure 15B:
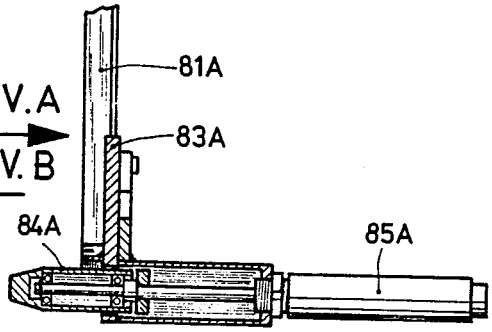

Above the finishing roller 3 there is a roll guide 80. The roll guide consists of an elongated guide rail 81 A, B, which is swivel-mounted in a swivel bearing 82 A, B at the top end. The swivel bearing 82 A, B is mounted in a fixed position on the machine framework 6. The swivelling movement of the roll guide rail 81 A, B is driven by a hydraulic cylinder 102 A, B, which is linked to a counter lever 90 A, B. The counter lever 90 A, B is connected to the roll guide rail 81 A, B in such a way that it cannot turn in relation to it. For synchronization with the opposite side, there is a spacer rod 89 A, B, which drives the shaft 87 via the lever 88 A, B. The shaft 87 is mounted coaxially in the stationary bearing tube 86. The roll guide rail 81 A, B extends in a straight line and has a roll guide carriage 83 A, B mounted on it. The roll guide carriage 83 A, B can move freely down to a bottom stop. There is a core pick-up 84 A, B on the roll guide carriage. This is designed as a hydraulically-actuated mandrel which, as can be seen in FIG. 15B, can be moved from an extended position, as shown in FIG. 15B, into a retracted, idle position by means of a hydraulic cylinder 85 A, B.

Unless explicitly stated otherwise in the text, the described shafts and axes of pivot bearings extend parallel to each other, i.e. parallel to the axes of the take-up roller 2 and the finishing roller 3 or perpendicular to the drawing planes of FIGS. 1–6 and 11.

Now the mode of operation of the device will be explained with particular reference to FIGS. 1–6, in which the parts are shown in detail in various operating positions as viewed in the direction of FIG. 11.

According to FIG. 1, the roll 100 is almost completely wound. The core 101 of this roll is in the roll guide 80 and the roll guide carriage 83 A, B, following the increasing diameter of the roll 100, has slid upwards in the roll guide rails 81 A, B. The roll is resting on the finishing roller 3 and is rotated by it, whereby it pulls the length of material 1 with it.

Related to FIG. 1, the carriage 11 A, B is in its winding-on position on the right. The distance between the take-up roller 2, when located in the winding-on position according to FIG. 1, and the finishing roller 3 is greater than the diameter of a partially wound roll plus the working width of the cutting mechanism measured in the direction of feed of the length of material. The cutting mechanism 27 is in its lowered, idle position. The layer arrangement 40 is in its swivelled-down, idle position and the core transfer 67 is swung upwards towards the magazine and is loaded with a new core 104.

Shortly before the roll 100 is fully wound, a control signal is given, which initiates the following process. Firstly, the core transfer 67 swings into the winding-on position shown in FIG. 2, where the new core 104 pushes down the functional section 26, so that the latter wraps round the take-up roller at a larger angle and then round the core 104, which comes into peripheral contact with the take-up roller 2, whereby the length of material 1 is between them. Moreover, the layer arrangement swings into the winding-round position shown in FIG. 2, whereby the winding roller 53 pushes through the functional section 26 from underneath and comes into position at the core 104, so that the material of the functional section 26 is wrapped round ca. half of the circumference of the core. The winding roller 53 and the auxiliary winding roller 52 are resting on the core 104 with the length of material between them.

As soon as the roll 100 is completed, a new control signal is given initiating the following process. The material feed is switched off. The cutting mechanism 27 goes into the cutting position as shown in FIG. 3 and cuts the functional section 26 of the length of material 1, which is now at a standstill. This is done close to the winding roller 53 so that the initial section 110 of the new section of the length or section of material 111 in accordance with double-headed arrow 106, that results during cutting, is not longer than the available circumferential section in accordance with double arrow 107 on the core 104 to be wound. The hydraulic cylinder 65 moves the rocking arm 63 into the laying position shown in FIG. 4, in which the laying roller 54 and the auxiliary laying roller 55 rest on the circumference of the core with the initial section 110 between them and the initial section is wrapped round more than three quarters of the core 104.

The measurements according to the double-headed arrows 106 and 107 are so calculated that the initial section fits over the available circumferential section of the core 104 ending with clearance space in front of the gap 109 between the core 104 and the take-up roller 2. The four rollers, i.e. The laying roller 54, the auxiliary laying roller 55, the winding roller 53 and the auxiliary winding roller 52, are evenly distributed on the available circumference of the core 104 opposite the take-up roller and form a guide for the new section 111 of the length of material. As soon as the rollers named above have assumed the positions shown in FIG. 4, the feed of the length of material is switched on again. Immediately after the cutting process, the cutting mechanism, 27 returned to the initial position shown in FIG. 4 and the roll guide 80 was swung through angle 115 to allow the full roll 100 to drop off.

Figure 4:
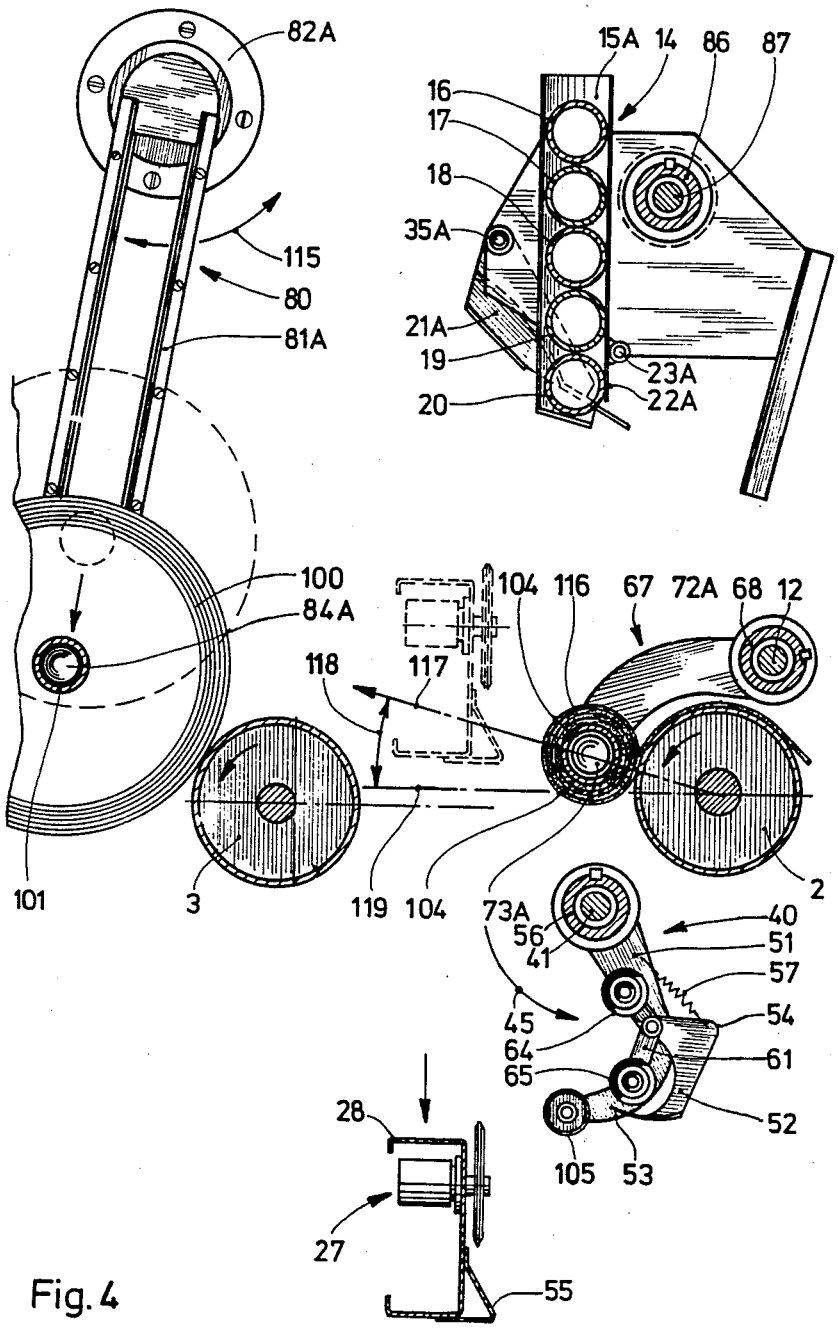

After the parts have assumed the positions shown in FIG. 4, the feed of the length of material is switched on again. The new initial section or leader 110 now enters the gap 109 and thus under the first layer of the length of material, whereby it is fixed into position. As soon as this has taken place, that is, as soon as the first layer of the material plus one revolution have formed on the new core 104, the pivoted lever 64 swings back into its initial position shown in FIG. 1. Shortly after the start of this swivelling movement, the layer arm 51 also swings back into its initial position.

The new roll 116 is wound onto the new core 104 by lying against the take-up roller 2. Now the carriage 11A, B is actuated and, together with the take-up roller 2 and the core transfer 67, it moves into the transfer position shown in FIG. 5, whereby the roll of material 116 remains in contact with the take-up roller 2. The distance between the take-up roller in the transfer position as shown in FIG. 5 and the finishing roller 3 is less than the diameter of a partially wound-on roll of material. The direction of the carriage movement in accordance with arrow 117 is at an acute angle 118 in accordance with the arrow to the connection line 119 between the take-up roller 2 and the finishing roller 3 in the winding-on position of the carriage as shown in FIG. 4. The carriage movement is initiated so early that, taking into account the size of the angle 118, the partially wound roll 116 can still be pushed over the finishing roller 3 with play. As the new roll continues to increase in size, it comes into contact with the finishing roller 3. The parts are now in the positions shown in FIG. 5. Now the mandrel of the core pick-up 73 A, B of the core transfer 67 is retracted. The core transfer swings back into the position shown in FIG. 6 taking the allotter 21 A, B, with it against gravitational force, which in turn opens the retaining flap 22 A, B against gravitational force. The mandrel of the core pick-up 84 A, B of the roll guide 80 is driven forward into the new core 104. The core transfer goes into a position in which its mandrels are in line with lowest core 20, which is placed in readiness in the core magazine 14, and the mandrels of the core transfer arrangement 67 take up this core. The parts are now in the positions shown in FIG. 6.

The carriage 11 A, B now returns to its initial position according to FIG. 1 and the core transfer takes the core 20, which was placed in readiness, with it, so that the other cores can drop down. The parts are now in the positions shown in FIG. 1 and the roll, which has assumed the position of roll 100 in FIG. 1, is completed.

Figure 16:
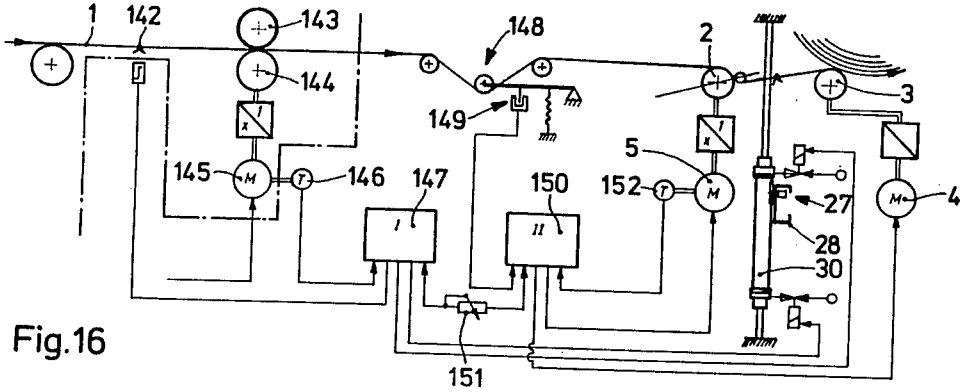
Figure 17:
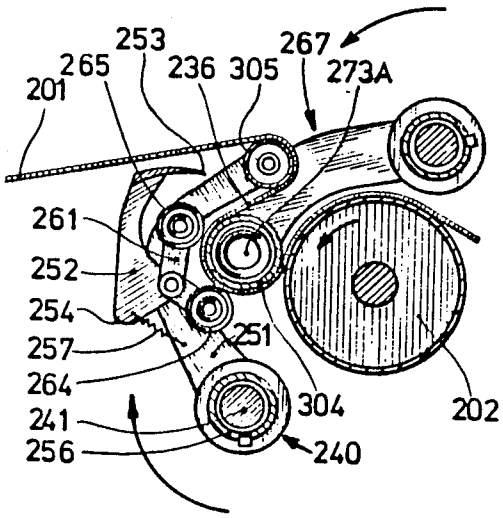
Figure 19:
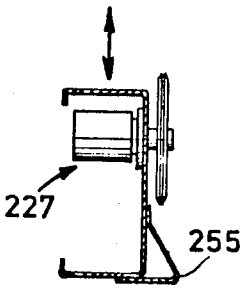

The control processes can be initiated automatically as now explained with reference to FIG. 16. In FIG. 16 some of the parts from FIGS. 1–15 are shown symbolically, whereby they are marked with the same reference numbers as in FIGS. 1–15. The parts located in front of the device in FIGS. 1–15 are drawn to the left or above the phantom line 140. The length of material 1 being fed passes a decoder 141 that is capable of registering a mark 142 on the material 1. This mark is made at the point where the material is to be cut. The material passes between the advancing rollers 143 and 144, which are driven by motor 145. This motor drives a pulse generator 146, whose pulse sequence is a measure for the length of material that has passed through. This pulse sequence and the output signal of the decoder 141 enter a computer 147. 148 demotes a tensioning arrangement with which the tension of the length of material 1 is constantly measured. A sensor 149 transmits a signal, which is dependent upon the tension, to a control unit 150. The control unit 150 is connected to the computer 147 via an adjusting element 151. The drive motor for the take-up roller 2 actuates a pulse generator 152, whereby the pulse sequence is dependent on the revolutions of the take-up roller. This pulse sequence enters the control unit 150. The drive motors 4 and 5 and the hydraulic cylinders 30 A, B are driven by the computer and the control unit.

Figure 17:
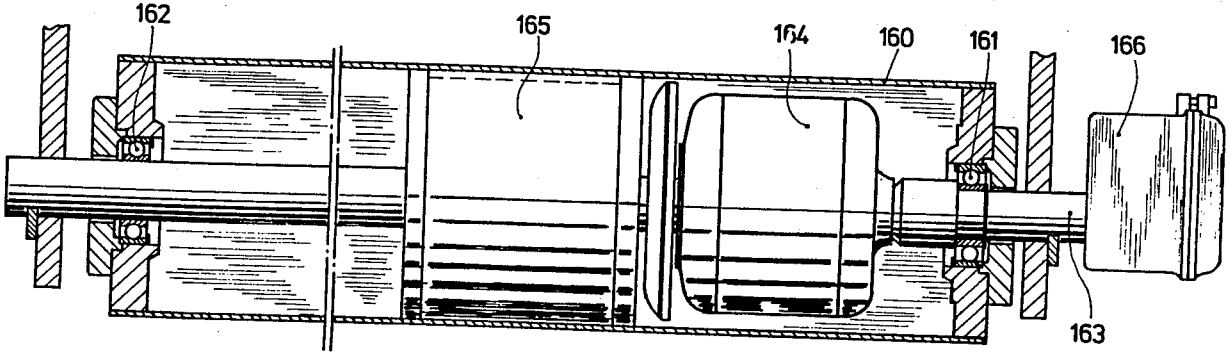

Unlike the illustrated design, the drive motors for the take-up roller and the finishing roller can also be installed inside the respective rollers. Such a take-up roller is shown in FIG. 17 and marked with the number 160. This take-up roller is mounted in ball bearings 161, 162 on a fixed axle 163. The drive motor 164 inside the take-up roller on the axle is mounted in such a way that it cannot turn in relation to it. The motor drives the take-up roller via a gear 165, which is also installed inside the take-up roller. The electric power supply is fed through the hollow axle 163 and comes from an external supply box 166.

In FIGS. 18 to 23, those parts which correspond to the parts of the first design in FIGS. 1 to 17 are demoted by the same reference characters plus 200. Whereas the design first described, the feed of the length of material must be interrupted each time for a new core, the feed of the length of material 201, which, with this design, can be a length of flexible fabric, is not interrupted, but, on the contrary, the length of material is fed continuously. For this purpose, the parts for fixing the leader of a new section of material to the empty core are designed differently to those in the first example.

Figure 18:
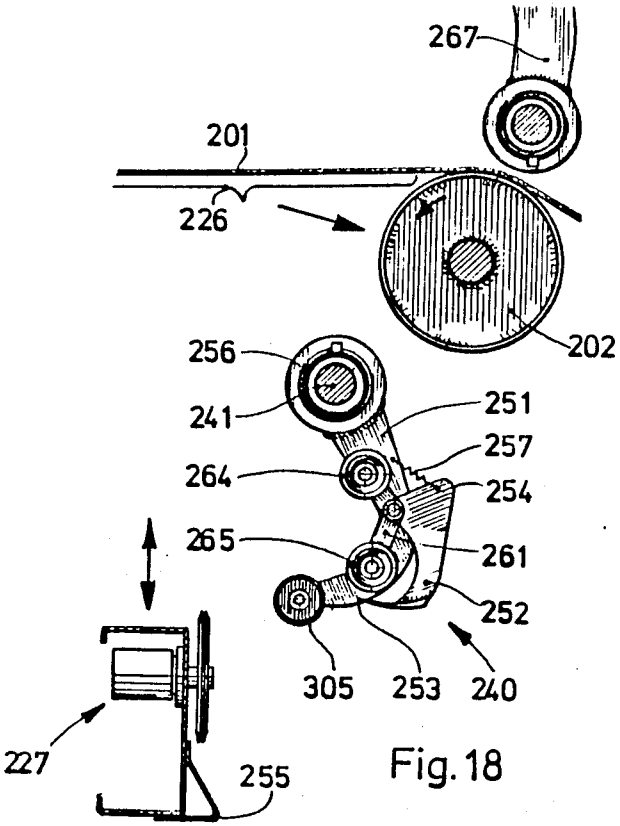

The device according to FIGS. 18 to 23 only differs in a few fundamental details from the device previously described with reference to FIGS. 1 to 17. In FIGS. 18 to 23 some details, which are exactly identical in design to those of the device previously described according to FIGS. 1 to 17, are no longer illustrated. The operating positions according to FIGS. 5 and 6 are no longer shown because the parts affected by the modification, namely the fixing arrangement 240 and the cutting mechanism 227, are shown in FIG. 18 in the same positions as they would assume according to FIGS. 5 and 6. The cutting mechanism 227 is identical in design to the cutting mechanism 27, it has merely been fitted with a moving means in the form of a shoulder 255.

In place of the layer arrangement 40 there is a fixing device 240, which serves to fix the new start of a section of the length of fabric to a new core that is to be wound. The fixing arrangement is seated on a hollow shaft 256 in such a way that it cannot turn in relation to it. The hollow shaft 256 is pivot-mounted coaxially to the shaft 241. The swivelling movements of the hollow shaft 256 are driven by a hydraulic cylinder 244 A, B via a hinged lever combination 260, which is connected to the hollow shaft 256 with the keyed bush 234 A, B in such a way that it cannot turn in relation to it. The hinged lever combination 260 features the hinged lever 262 A, B. The filing arrangement is mounted on the hollow shaft in such a way that it cannot turn in relation to it, but that it can be adjusted axially. The fixing arrangement is adjusted axially by hand according to the working width.

Figure 20:
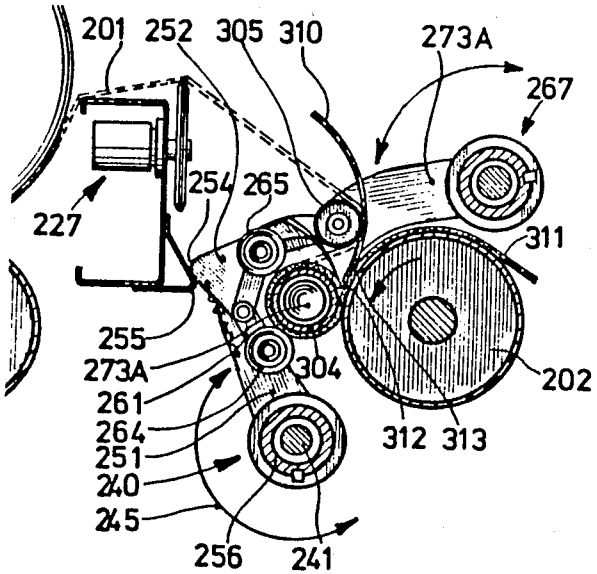

With every fixing cycle, the hollow shaft 256 turns back and forth through an angle range 245 of more than 180°. The fixing arrangement 240 consists of four identical fixing elements 246 to 249. All the fixing elements are seated on the same hollow shaft 256 and therefore they move synchronously. The four fixing elements 246 to 249 extend across the working width of the material being processed. Additional fixing elements can be added for wider webs of material. Fewer elements are sufficient for narrower lengths of material. The fixing element 246 seen in FIG. 22 features a lever arm 251, which is connected to the hollow shaft 256 in such a way that it cannot turn in relation to it. Mounted on this arm is a pivoted turning arm 252, which is spring loaded by a tension spring 257. The turning arm 252 has a rounded-off turning edge 253. The turning edges of all four elements 246 to 249 extend across the complete width of the length of material 201. The turning arm 252 also features an actuating shoulder 254, which, when the fixing arrangement is in the winding-round position shown in FIG. 20, is located in the path of the actuating shoulder 255 of the cutting mechanism. Moreover, there is a pivoted rocking arm 261 with two laying rollers 264 and 265 on the fixer arm 251. The laying rollers are rotatably mounted. On the free end of the arm 251 there is the rotatably-mounted winding roller 305.

The operational mode of the device will now be explained with particular reference to FIGS. 18 to 21, in which the parts are shown in detail in various operating positions as viewed in FIG. 22.

In the position of the parts in FIG. 18, the roll 300 is almost completely wound. The core 301 of this roll is in the roll guide 280 and the roll guide carriage 283A, B, following the increasing diameter of the roll 300, has slid upwards in the roll guide rail 281 A, B. The roll is resting on the finishing roller 203 and is rotated by it, whereby it pulls the length of material 201 with it.

The carriage 211 A, B is in its winding-on position on the right. The distance between the take-up roller 202 in the winding-on position and the finishing roller 203 is greater than the diameter of a partially wound roll plus the working width of the cutting mechanism measured in the direction of feed of the length of material. The cutting mechanism 227 is in its lowered, idle position. The fixing arrangement 240 is in its swivelled-down, idle position and the core transfer 267 is swung upwards towards the magazine and is loaded with a new core 304.

As soon as the roll 300 is fully wound, a control signal is given, which initiates the following processes. Firstly, the core transfer 267 swings into the winding-on position shown in FIG. 19, in which the new core 304 pushes down the functional section 226, so that it winds round the take-up roller 202 at a larger angle and then round the core 304, which comes into peripheal contact with the take-up roller 202, whereby the length of material 201 is between them. In addition, the fixing arrangement 240 swings into its winding-round position shown in FIG. 19, wherein the winding roller 305 pushes up through the length of material of the functional section 226 and takes up a position with intermediate space 236 above the core 304, so that the material of the functional section 226 is wound round almost three quarters of the circumference of the core.

The two laying rollers 264, 265 are applied to the circumference of the core 304 with the length of material between them. The turning arm 252, which is loaded by the tension spring 257, is in an idle position. The cutting mechanism 227 now moves into the cutting operating position shown in FIG. 20 and cuts the functional section 226 of the length of material 201. On the way up the actuating or moving shoulder 255 of the cutting mechanism 227 hits the actuating shoulder 254 of the turning arm 252 and bodily moves the latter, against the bias of the spring 257, into the operative position shown in FIG. 20. In this position, the turning arm with its turning edge 253 drives through between the winding or draping roller 305 and the core 304 into the space 312 between the take-up roller 302 and the new core 304, whereby it takes the leader 310 of the new section 311 of the length of material with it, forcing it into this gap 312. At the same time the length of material is fed without interruption and the take-up roller 202 and the finishing roller 203 continue to turn. Due to the rotation of the take-up roller 202, the fold produced by the turning arm 313, and thus the new section of the length of material 311, is drawn into the gap 312 and the new section of the length of material 311 is wound onto the new core 304. As a result, the leader 310 is wound in and fixed firmly to the core.

Figure 21:
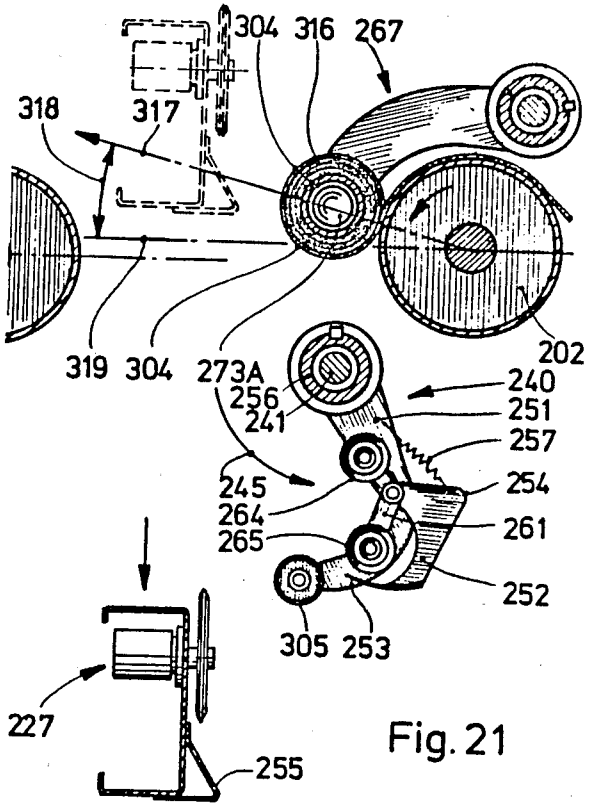
Figure 22:
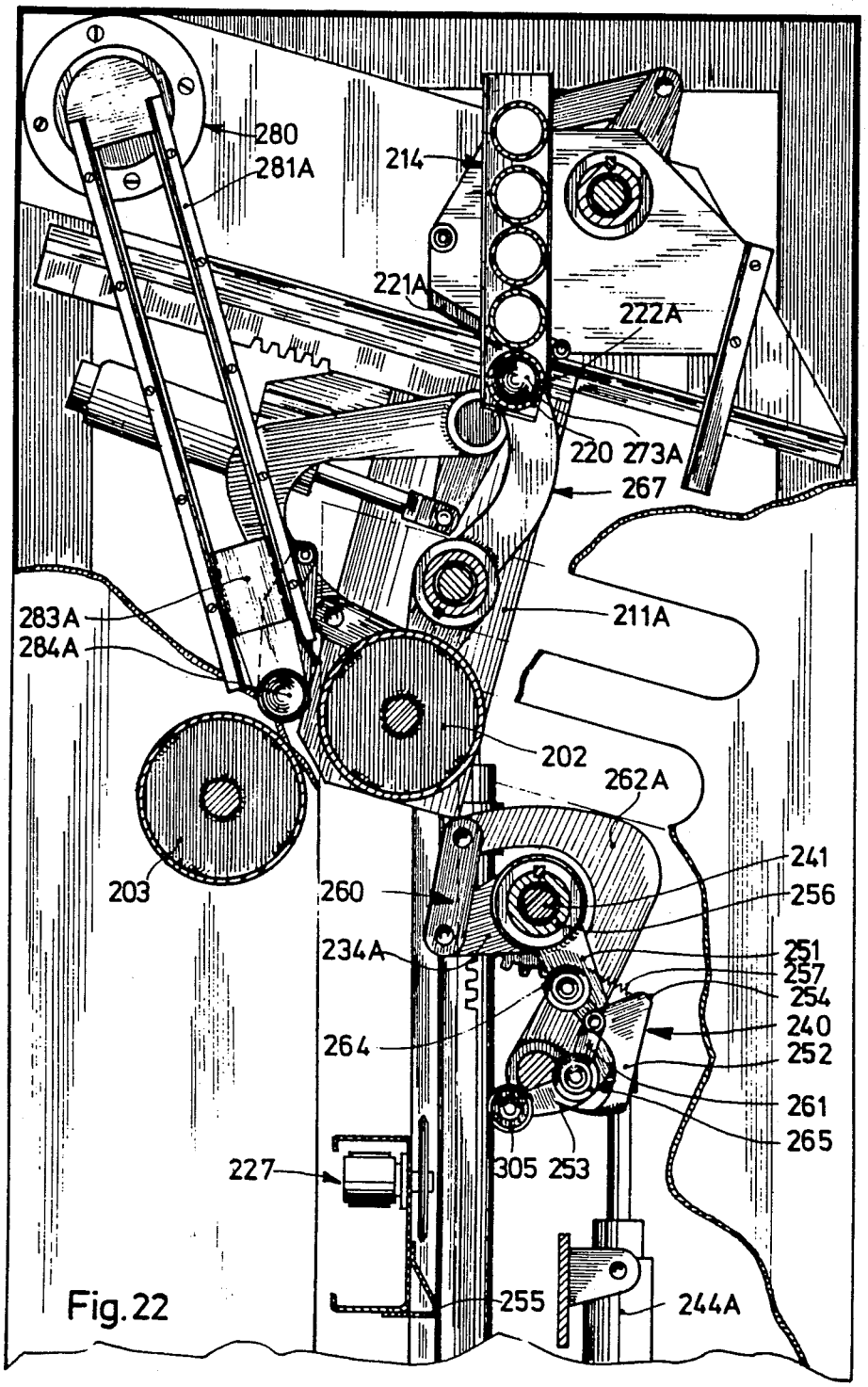
Figure 23:
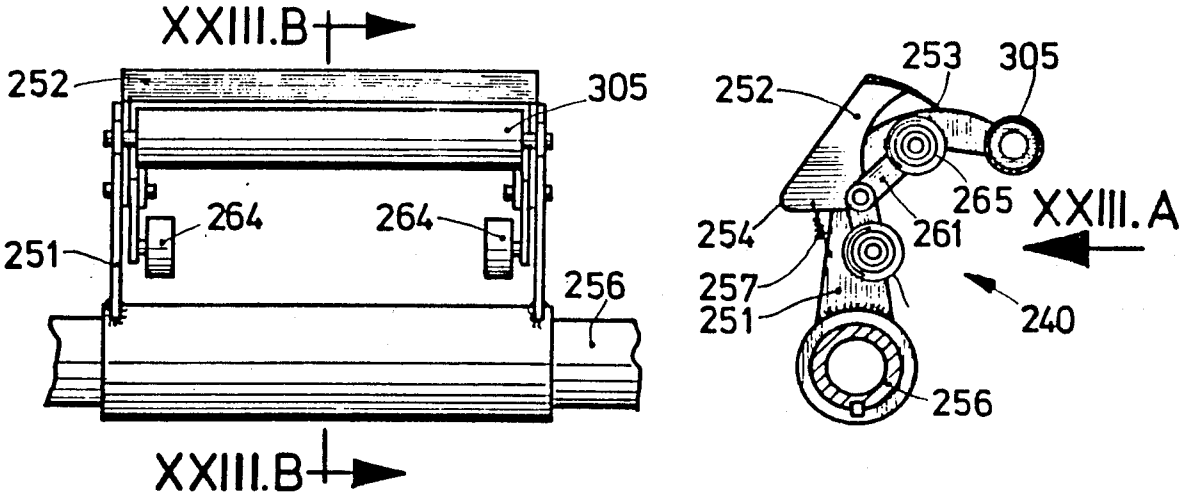

The cutting mechanism 227 and the fixing arrangement 240 now withdraw into their idle positions as shown in FIG. 21. At the same time, the roll guide 280 is swung through an angle 315, so that the full roll 300 can drop off. The new roll is wound onto the new core 304 by lying against the take-up roller 202. Now the carriage 211 A, B is actuated and moves, together with the take-up roller 202 and the core transfer 267, into the transfer position, whereby the roll of material remains in contact with the take-up roller 302. The distance between the take-up roller 202 in the transfer position and the finishing roller 203 is less than the diameter of a partially wound-on roll of material. The direction of the carriage movement in accordance with arrow 317 is at an acute angle 318 to the connection line 319 between the take-up roller 202 and the finishing roller 203 in the winding-on position of the carriage shown in FIG. 21. The carriage movement is initiated so early that, taking into account the size of the angle 318, the partially wound roll can still be pushed over the finishing roller 203 with play. As the new roll 316 grows in size, it comes into contact with the finishing roller 203.

Now the mandrel of the core piok-up 273 A, B of the core transfer 267 is retracted. The core transfer swings into the position shown in FIG. 22, taking the allotter 221 A, B with it against gravitational force, which in turn opens the retaining flap 222 A, B against gravitational force, and the mandrel of the core pick-up 284 A, B of the reel guide 280 is driven into the new core 304. The core transfer goes into a position in which its mandrel are in line with the lowest core in the core magazine 214 and take up this core. The parts are now in the positions shown in FIG. 18.

The carriage 211 A, B now returns to its initial position and the core transfer takes the core 220, which was placed in readiness, with it, so that the other cores can drop down. The parts are now in the positions shown in FIG. 18 and the roll is completed.

I claim:

1. In an apparatus for winding successive sections of a web of flexible material around successive cores of a series of cores, the combination of means for advancing the web in a predetermined direction along a predetermined path; a source of cores at one side of said path; a rotary winding member at the other side of said path; means for repeatedly cutting the web downstream of said winding member so that the web is subdivided into a succession of sections each having a leader, said cutting means being movable to and from an operative position; means for transferring cores from said source into engagement with successive sections whereby the sections set the cores in rotary motion, including means for urging the sections against the winding member by way of the respective cores so that the leader of each section extends in said direction beyond the respective core; means for draping each of the leaders around the respective core including at least one first draping member, means for displacing the first draping member into engagement with the first portion of the leader downstream of the winding member so that a second portion of the leader projects beyond the first draping member, at least one second draping member movable relative to the first draping member toward an operative position to thus move the second portion of the leader of a freshly formed section against the core downstream of the first draping member, as seen in the direction of rotation of the core; and means for bodily moving of the second draping member and the cutting means to its operative position in response to movement of the other of said operative position.

2. The combination of claim 1, wherein said means for bodily moving comprises a shoulder on said cutting means.

3. The combination of claim 1, further comprising means for biasing at least one of said parts from the operative position.

* * * * *

UNITED STATES PATENT AND TRADEMARK OFFICE

CERTIFICATE OF CORRECTION

PATENT NO. : 4,901,934

DATED : February 20, 1990

INVENTOR(S) : Heinrich SCHNELL

It is certified that error appears in the above-identified patent and that said Letters Patent is hereby corrected as shown below:

Foremost Page: Item [63] should read -

-- PCT/EP85/00398 filed Aug. 6, 1985, is a continuation of Ser. No. 855,817, Aug. 10, 1986, abandoned. --

Col. 1, line 12, "taken-up" should read --take-up--.

Col. 2, line 3, "upwards" should read --inwards--.
Col. 3, line 11, "open-" should read --operat- --.
Col. 5, line 28, delete "of" and after "A, B" insert --of--.

Col. 9, line 5, "filing" should read --fixing--.
Col. 10, line 53, delete "316".
Col. 12, line 10, after "moving" insert --one--.
line 13, after "said" insert --second draping member and said cutting means to its--.

Signed and Sealed this

Twenty-fourth Day of December, 1991

*Attest:*

HARRY F. MANBECK, JR.

*Attesting Officer*

*Commissioner of Patents and Trademarks*